US006438787B1

(12) United States Patent
Young

(10) Patent No.: US 6,438,787 B1
(45) Date of Patent: Aug. 27, 2002

(54) BACK APPLICATOR

(76) Inventor: Sidney Ann Young, 2814 Fleur Dr., San Marino, CA (US) 91108

( * ) Notice: Subject to any disclaimer, the term of this patent is extended or adjusted under 35 U.S.C. 154(b) by 0 days.

(21) Appl. No.: 09/345,623

(22) Filed: Jun. 30, 1999

(51) Int. Cl.[7] ..... A47K 7/03; B05C 1/06; A46B 5/02

(52) U.S. Cl. ..... 15/210.1; 15/209.1; 15/143.1; 15/145; D28/7

(58) Field of Search ..... 15/209.1, 210.1, 15/145, 176.5, 176.6, 176.1, 244.1, 104.94, 143.1, 184; 401/207, 6, 7, 266, 262, 202, 196; D28/7; 132/317

(56) References Cited

U.S. PATENT DOCUMENTS 4,299,005 A * 11/1981 Brown ..... 15/104.94
4,381,766 A * 5/1983 Avolio ..... 15/143.1
4,483,636 A * 11/1984 Meyer
4,934,024 A * 6/1990 Sexton
5,155,878 A * 10/1992 Dellis
5,360,111 A * 11/1994 Arispe
5,659,916 A * 8/1997 Beatty et al. ..... 15/210.1
5,671,497 A * 9/1997 Abdo ..... 15/244.1
5,673,455 A * 10/1997 Per-Lee et al. ..... 15/210.1
5,692,261 A * 12/1997 Lops ..... 15/209.1
5,931,591 A * 8/1999 McCracken ..... 401/6
6,045,279 A * 4/2000 Follis ..... 401/6

* cited by examiner

*Primary Examiner*—Gary K. Graham
(74) *Attorney, Agent, or Firm*—Walter Unterberg

(57) ABSTRACT

A hand held back applicator for spreading emollients on one's back and other body parts, consisting of a curved handle with a grip, attached to a head with an absorbent pad accommodating the emollients. The pad is attached to the head by pressure-sensitive hook-and-loop strips, enabling it to be quickly detached for laundering and later re-attachment, or replacement. A cover which completely encloses the head with pad attached, shields against loss of emollients and permits hygienic storage and packing. Further, the head can be detached from the handle, so that the head, with pad and cover in place, can be stored and transported separate from the handle and grip. Handle and head are made of rigid plastics, the grip of vinyl, and the pad is designed for repeated hygienic hot water-soap washing, dryer cycles, and many re-uses. The dimensions of grip, handle, head and pad are economically selected for best results with maximum comfort and minimum operating cost.

5 Claims, 3 Drawing Sheets

SECTION 10-10

BACK APPLICATOR

BACKGROUND OF THE INVENTION

1. Field of the Invention

This invention relates to applicators which spread lotions and similar liquefied products on the human skin. In particular it relates to economically designed applicators for self-applying such products on the surface of one's back by means of detachable pads which can be washed and reused.

2. Description of Related Art

Persons living in hot and dry climates frequently find it necessary to add moisture to their skin by means of various liquefied products. These include lotions, tanning oils, moisturizing oils, creams, sun screens, over-the-counter medications, analgesics, powders, and similar products. The preferred means for spreading such products on the skin, other than by hand, are hand-held applicators whose heads are charged with the product to be spread on the skin. Persons who self-apply moisturizers find some parts of the human anatomy hard to reach, particularly one's back.

Various applicators have been devised for general use and hard-to-reach body parts, but they suffer from drawbacks related to their ergonometry, method of charging with product, economy of product use, and preparation for a subsequent application.

A Lotion Applicator (U.S. Pat. No. Des. 297,467) marketed under the name of L'Applique in Dr. Leonard's Health Care catalogue, Edison, N.J. 08837, is also very similar to one in the Blair catalogue, Warren, Pa. 16366. This device has a handle too thin for good control, with an awkward grip presenting problems for medium-and large-handed or disabled people. The head frame and sponge applicator is too small for proper application of product which tends to be wasted. The sponge is rough on the skin and of inferior quality, subject to rapid deterioration with minimal repeated washing. The device is too long and cumbersome to pack, transport or store, and lacks a protective cover.

The Lotion Applicator marketed by the Body Shop (International Corporation, Great Britain) has a handle which is too short, a grip which is inadequate, and a rough sponge which has too large an area and does not sufficiently absorb product and so wastes it. The sponge is permanently attached to the handle, is difficult to clean and is of inferior quality, leading to rapid deterioration. This device, too, is cumbersome to pack, transport or store, and lacks a protective cover.

The Easy Reach Lotion Applicator marketed by Vermont Country Store Apothecary Catalogue, Manchester Center, Vt, has a gripless handle which is too thin for good control. The non-removable sponge is non-absorbent, rough on the skin, wasteful of product, difficult to clean, and deteriorates rapidly. The device, too, is cumbersome to pack, transport or store, and lacks a protective cover.

The Lotion Wand (U.S. Pat. No. 5,125,757) marketed by Vermont Country Store Catalogue, Weston, Vt, features rolling ball and sponge applicators in parallel, supplied with product from a reservoir. The thin, straight, gripless handle cannot be securely grasped and makes it difficult to reach all areas of the human back.

In a test of this device, oils and thinner creams were observed to leak out of the slits around the ball applicator when balls were stationary. In use, the balls were rough on the skin and did not apply product evenly. The applicator sponge, designed to be used after the balls, was also rough on the skin, could not be cleaned adequately, and deteriorated rapidly with minimal repeated use. It was necessary to use both balls and sponge to disperse product evenly over skin surfaces.

This review of long-reach lotion applicators currently on the market has determined that these devices incorporate features which are not adequate for their purpose. Hence the aim of the present invention is to overcome these defects, as listed in the following objects.

OBJECTS OF THE INVENTION

The objects of the present invention are 1. to provide a back applicator which is economically designed to reach all areas of the human back during self-application;
2. to provide a back applicator which can be securely grasped and accurately deployed over a desired hard-to-reach skin region;
3. to provide a back applicator which dispenses products of various viscosities evenly and comfortably and without waste over a desired skin region with beneficial effect;
4. to provide a back applicator with product dispensing means designed to function properly over a very large number of repeat applications;
5. to provide a back applicator which can be hygienically cleaned after use and stored in a protective cover without polluting the environment or being polluted by it; and
6. to provide a back applicator which will function properly during repeated use extending over a very large number of applications.

These and other objects have been implemented in the present invention, as described in the adjacent Summary of the Invention, followed by a Detailed Description with the aid of suitable Drawings to illustrate the complete invention.

SUMMARY OF THE INVENTION

To implement the stated Objects of the Invention, a hand held back applicator has been devised. The invention comprises a rigid handle with a hand grip at one end, connected to a rigid head at the other end.

Spreading an emollient of choice on one's back is performed by an absorbent pad, saturated with the emollient, attached to the head by means of two pressure-sensitive strips. One strip with outward facing hooks is permanently attached to a recess in the head, and another strip of the same area with outward facing loops is sewn to the absorbent pad. Pressing the pad strip against the head strip attaches the pad firmly to the head by virtue of the pressure-sensitive nature of the strips which are commercially available as Scotch Mate strips.

Grasping the handle by the grip, the absorbent pad is manually directed onto the areas of the back, or other body part, over which it is desired to spread the emollient. Experiments were made to develop a back applicator with ergonomic features in terms of geometry and weight, accurately deployable over any hard-to-reach skin region. The results are a curved plastic handle ¾ inch in diameter and one foot in length, with a one-inch curve, equipped with a grooved molded vinyl grip extending over one-quarter the handle length. The handle is typically made of clear cast acrylic.

Further, to ensure an even spread of emollient and an adequate emollient reservoir, the absorbent pad is made of loop-type sewn terrycloth filled with quilting batting to a thickness of 1.5 inch with a basic application area of 3.25×4.25 inch. This is also the area on the head to which the pad is attached. However, the matching pressure-sensitive strips are smaller, both 2×3 inch, adequate to hold the pad firmly to the head. The pad also features a care label.

With this design, the pad can be easily removed by peeling it from the head. The pad can be laundered in a hot soap/water solution, regular-dryer-cycled, then re-attached to the head, and re-used. This can be done for many repeated applications, with different types of emollients, without damaging the long-wearing pad. Alternatively, replacement pads can be quickly installed with the pressure-sensitive strips.

The final component of the applicator is a removable sliding cover which snugly encloses the head-pad combination to provide for hygienic storage and transportation, and also to seal the pad against leakage of any emollient. The cover dimensions to match the head and pad geometry are 3.1×4.2×1.5 inch. Both head and cover are made of rigid plastic, typically molded clear polypropylene.

To further facilitate storage and transportation, the connection betwen handle and head can be broken, so that the applicator can be split into two parts, the head-pad-cover combination and the handle with grip. Such a detachable connection can take the form of a female boss integral with the head, of the same i.d. as the o.d. of the handle (0.75 inch). A small protruding radial pin (typically 0.25 o.d.) near the head end of the handle is a snug fit in a matching indexing cutout in the boss, so arranged that a half-turn of the handle in one direction locks in the head, and in the other direction unlocks the head for removal.

The operation of the back applicator consists of first locking the head to the handle in the manner described above, then with the cover off attaching the dry pad to the head using the pressure-sensitive strips. Lastly, with the pad facing up, apply emollients of choice to the pad. This can be done by pouring, squirting, smearing or dabbing, or even dipping the pad. The products may include various consistencies of tanning or moisturizing oils, lotions, creams, sun screens, over-the-counter medications, analgesics, powders, and the like.

To use as a back applicator, adjust grasp on grip so that the full curve of the handle is obtained, and lift the applicator over or around one's shoulder and place pad face in full contact with skin surface. Alternatively, the applicator may be moved upward from the base of the lower back. Glide the applicator over the desired skin surface areas again, adjusting individual grasp as necessary for comfort and efficiency.

When the application is finished, bring arm down and/or around to front of body, slip cover over pad and head, and store or pack in one piece (or two pieces by detaching head from handle). Alternatively, peel off pad from head and give it a hot water soapsuds wash and rinse in a washing machine, followed by drying in a clothes dryer. When pad is dry, re-attach to head for next application, cover, and store or pack in a traveling bag for gym or each, or in a backpack or suitcase, or elsewhere, as needed.

The applicator can also be used as described above without emollients or medications for those in late-stage pregnancy, handicapped, or requiring between the legs hygiene.

This Summary has described the various structural and operational features of the present back applicator invention. It is seen that the invention meets the stated objects and has the advantages claimed for it.

BRIEF DESCRIPTION OF THE DRAWINGS

A better understanding of the invention may be gained by reference to the following Detailed Description in conjunction with the drawings provided in which.

DETAILED DESCRIPTION OF THE PREFERRED EMBODIMENTS

Figure 1:
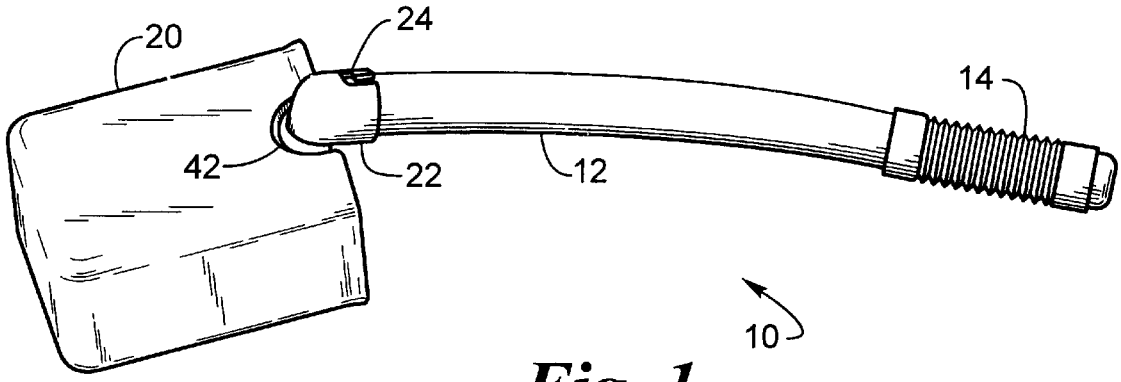
FIG. 1 is a pictorial view of the assembled Back Applicator of the invention.
Figure 6:
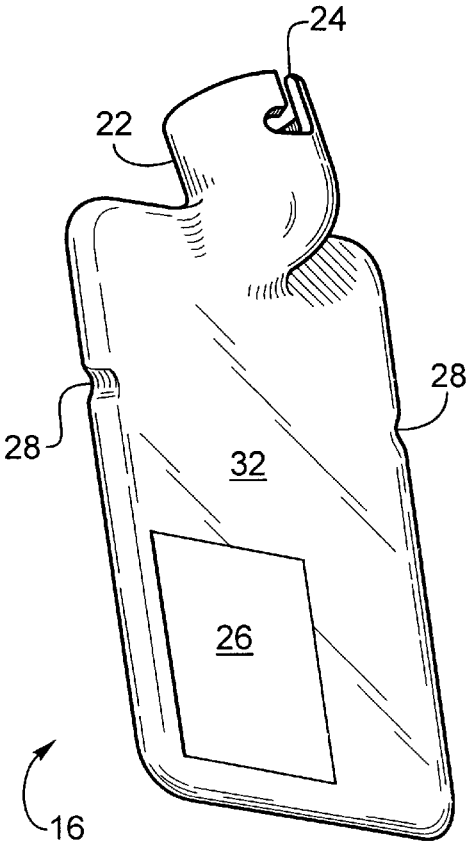
FIG. 6 is a top pictorial view of the head of the Back Applicator.
Figure 7:
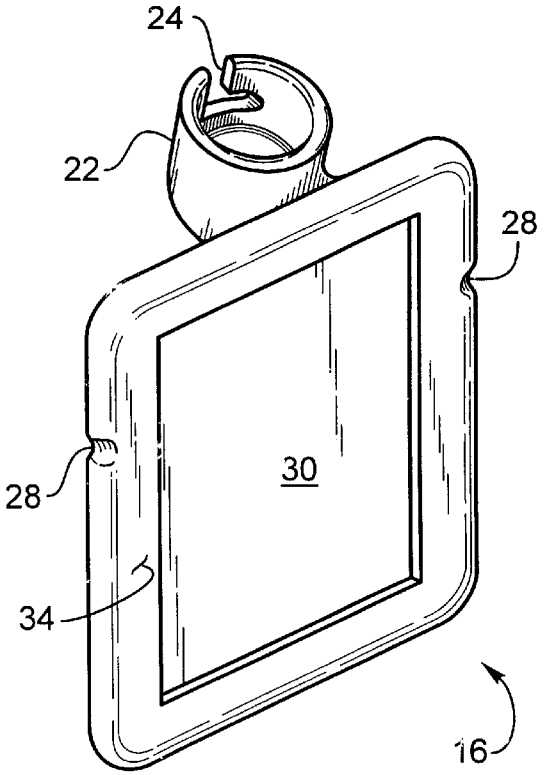
FIG. 7 is a bottom pictorial view of the head of the Back Applicator.

FIG. 1 shows a pictorial view of the assembled Back Applicator invention 10 with a cover 20 in place. A grooved flexible grip 14 is slid over one end of a long curved rigid handle 12 whose other end fits into a boss 22 and engages via a protruding radial pin (not shown) with an indexing cutout 24. Boss 22 and cutout 24 both are integral with a head 16, as shown in FIG. 6 and FIG. 7.

Figure 8:
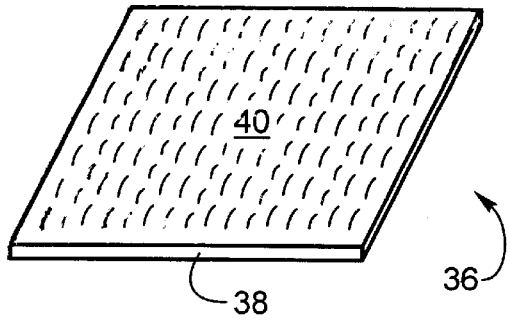
FIG. 8 is a pictorial view of the head strip.
Figure 9:
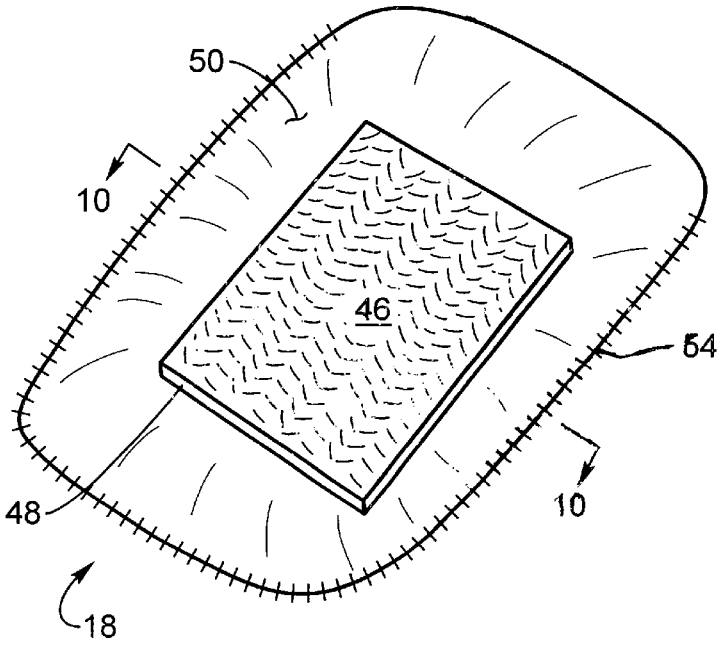
FIG. 9 is a top pictorial view of the pad of the Back Applicator, with section plane and arrows 10—10 indicated.

The active component of Applicator 10 is a pad 18 shown in FIG. 9, releasably attached to head 16 by a pressure-sensitive hook-and-loop double-strip configuration. Typically, this configuration consists of a head hook strip 36 shown in FIG. 8 which engages a same-sized contra pad loop strip 48 shown in FIG. 9. Strip 36 is permanently attached by its adhesive face 38 (FIG. 8) to a recess 30 of head 16 shown in FIG. 7. The hooks on attaching face 40 of head strip 36 (see FIG. 8) engage the loops on attaching face 46 of contra strip 48 which is permanently attached (typically sewn) to pad 18 as shown in FIG. 9. This double-strip configuration permits rapid attaching and detaching (and replacement) of pad 18 to and from head 16. Commercially available Scotch Mate strips may be used for strips 36 and 48.

The rigid connections of grip 14 to handle 12 to head 16, with pad 18 in place on head 16 by means of pressure-sensitive hook-and-loop strips 36 and 48, permit applicator 10 to be grasped by grip 14 and used to spread an emollient of choice placed on pad 18 on one's back or other body parts. After use, cover 20 can be slipped over the combined head 16 and pad 18 to completely prevent any leakage of emollient from pad 18 to the surroundings and for hygienic storage and packing.

Figure 2:
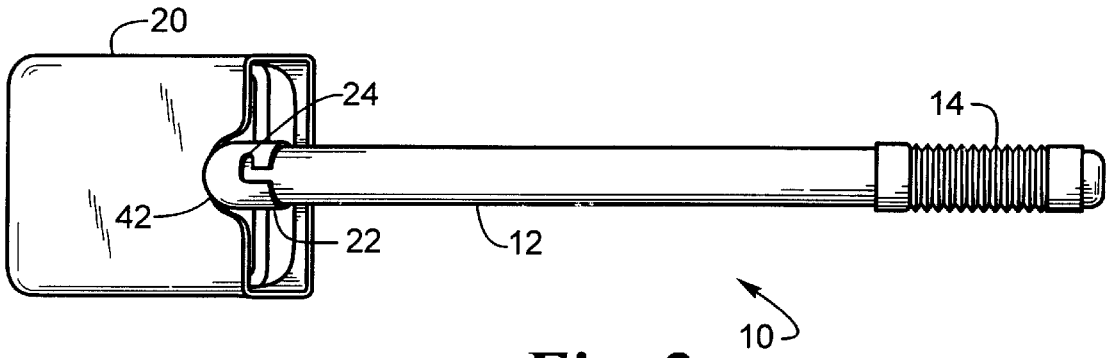
FIG. 2 is a top breakaway view of the assembled Back Applicator.
Figure 11:
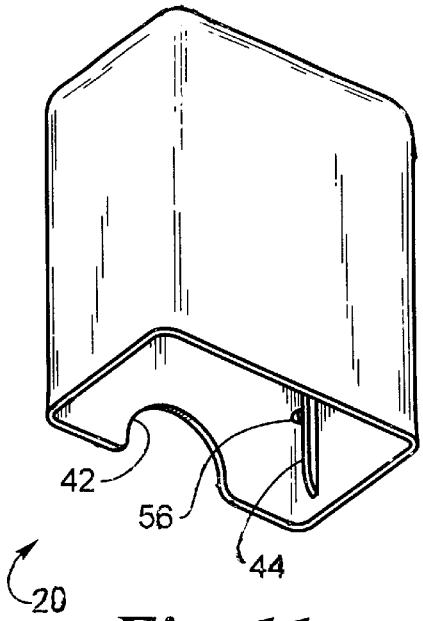

Additional details of applicator 10 remain to be described. Cover 20, as shown in FIG. 1, FIG. 2, and FIG. 11, has an arcuate cutout 42 on its upper surface, designed to make room for boss 22 of head 16 when cover 20 is completely in place. An internal guide rail 44 of cover 20 (see FIG. 11) frictionally engages pad 18 for a firm closure when cover 20 is completely in place. Further, internal projections 56 on cover 20 (see FIG. 11) engage notches 28 on the periphery of head 16 (see FIG. 6 and FIG. 7), to latch cover 20 in place on head 16. A small amount of manual force suffices to overcome the frictional and latching forces when it is desired to remove cover 20 from head 16 and pad 18.

Grip 14 has molded grooves similar to a grip on bicycle handle bars. Typically, as shown in FIG. 1 (true) and FIG. 2 (breakaway), grip 14 covers one-quarter of the length of handle 12, leaving three-quarters of handle 12 exposed.

Figure 3:
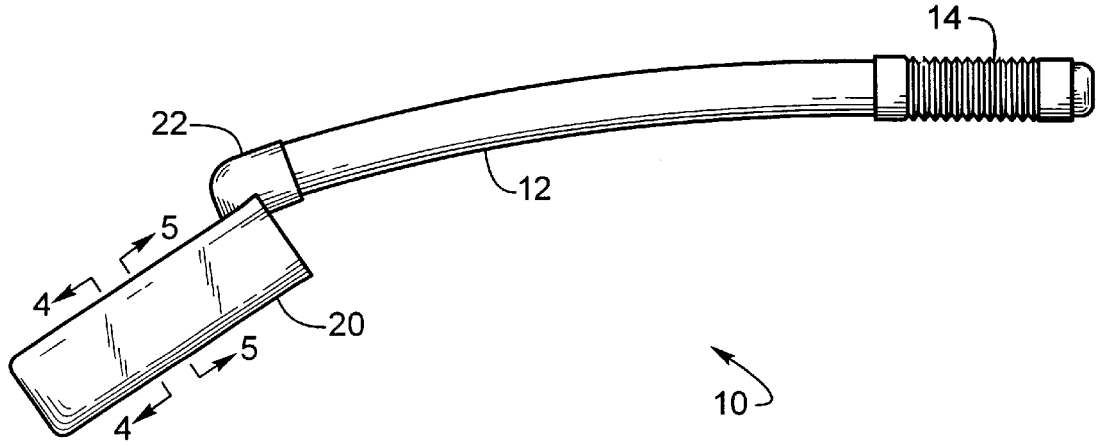
FIG. 3 is a partial side view of the assembled Back applicator, with section planes and arrows 4—4 and 5—5 indicated.
Figure 4:
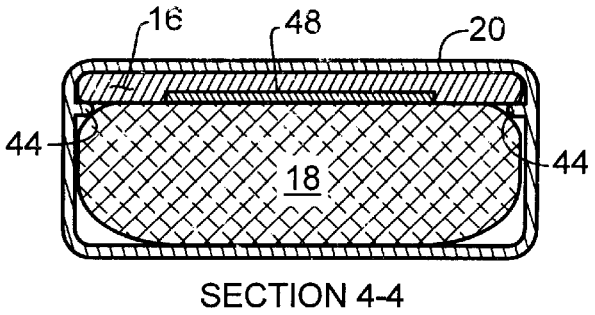
FIG. 4 is a sectional view of FIG. 3 taken along arrows 4—4
Figure 5:
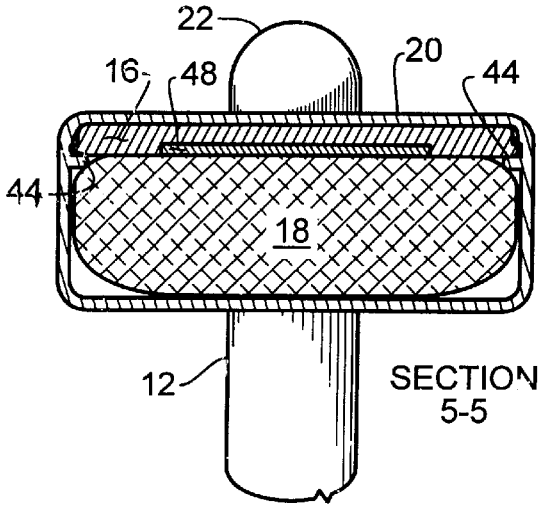
FIG. 5 is a sectional view of FIG. 3 taken along arrows 5—5

FIG. 3, FIG. 4, and FIG. 5 show sections 4—4 and 5—5 of cover 20 when cover 20 is fully in place over head 16 and pad 18. In particular, contra pad strip 48 and guide rails 44 are shown.

FIG. 6 and FIG. 7 show details of head 16. Head upper surface 32 is the base for boss 22, and also has a logo area 26 for indicia. Head lower surface 34 has a central recess 30 for the permanent attachment of adhesive face 38 of head hook strip 36, see FIG. 8. Two notches 28 are provided at opposite locations on the circumference of head 16 for engaging with projections 56 in cover 20.

Figure 10:
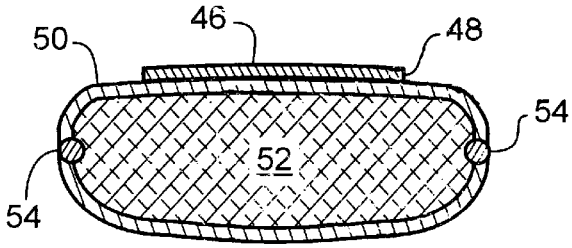
FIG. 10 is a sectional view of FIG. 9 taken along the arrows 10—10 and FIG. 11 is a pictorial view of the cover of the Back Applicator.

FIG. 9 and FIG. 10 (a section along arrows 10—10 on FIG. 9) show details of pad 18 which is pillow-shaped and covered in terrycloth. Shown is the construction in which a double layer of terrycloth 50 is stitched along seam 54 to form the pillow enclosure which is filled with quilting batting 52. To one pillow face there is sewn contra loop strip 48, identical in area with matching head strip 36 (see FIG. 8). Loop attachment face 46 of strip 48 faces out for engagement with head hook attaching face 40 of strip 36 (FIG. 8). A care label, not shown, can also be attached to pad 18.

A practical realization of the Back Applicator invention has the following materials and dimensions:

Handle 12: One foot long, 0.75 inch o.d., clear cast acrylic rod fabricated to a one-inch curve, with a protruding 0.25 inch o.d. radial pin (not shown in the Figures) to engage and lock into indexing cutout 24 when handle 12 is assembled to boss 22 on head 16;

Grip 14: 3.25 inch long, 0.75 i.d. molded grooved vinyl, to be a snug fit over handle 12;

Head 16: 3×4 inch molded clear polypropylene with recess 30 to attach 2×3 inch hook Scotch Mate strip 36;

Pad 18: 3.25×4.25×1.5 inch sewn loop-type terrycloth 50, filled with quilting batting 52, attached to 2×3 inch loop Scotch Mate strip 48, with care label; and Cover 20: 3.1×4.2×1.5 inch molded clear polypropylene.

The mode of operation, care and storage of the Back Applicator invention, and the various advantages of this invention have been fully described in the Objects and Summary of the Invention earlier in this specification.

Although the present invention has been described in considerable detail in its preferred embodiments, other realizations of specific components are possible without departing from the spirit and scope of the invention as delineated in the appended claims.

I claim:

1. A hand held back applicator for spreading emollient on one's back and other body parts, said back applicator comprising:

a hand held grip made of grooved molded vinyl;

an elongated slightly curved handle rigidly attached to said grip at one end of said handle, said handle being sufficiently long to reach all places on one's back;

a head rigidly and detachably attached to an opposite end of said handle;

an absorbent pad detachably attached to said head, said pad, when supplied with emollient, spreading emollient on one's back and other body parts by manual motions of said grip transmitted via said handle to said head and said pad; and a cover for enclosing the combination of said head and said pad to prevent leakage of emollient from said pad to surroundings and to provide hygienic storage and packing;

whereby said pad may be detached from said head for laundering and subsequently re-attached to said head;

whereby one said pad may be replaced by a different said pad; and whereby said back applicator may be separated into two combinations for convenient storage and transportation, the first combination comprising said grip attached to said handle, and the second combination comprising said head attached to said pad enclosed by said cover.

2. The back applicator of claim 1 wherein:

said handle is made of clear cast acrylic circular rod with a small protruding radial pin near said opposite end of said handle;

said head is plate-shaped and made of molded clear polypropylene, having a major surface with a circular boss sized to receive said opposite end of said handle, said boss further comprising an indexing cutout placed and sized to receive said radial pin in said handle, whereby suitable rotation of said handle in said boss attaches and detaches said handle to and from said head;

said head further has an opposite major surface with a recess to which is permanently attached a head strip with its free surface having pressure-sensitive hooks;

said pad is pillow-shaped, with each face matching said head surface in extent, said pad covered with loop type terrycloth and filled with quilting batting, with one face of said pad having sewn to it a contra strip in size matching said head strip, the free surface of said contra strip having pressure-sensitive loops, whereby said pad is attached to and detached from said head by pressing together and pulling apart said contra strip with loops and said head strip with hooks; and said cover is box-shaped and so sized to slidably enclose through one open face the combination of said pad attached to said head, said cover having an arcuate cutout to accommodate protrusion of said boss in the enclosed position, also having an internal guide rail for frictional contact with said pad to prevent unwanted separation of said cover from said combination head and pad, and further having internal projections to engage matching notches in a periphery of said head when enclosing said combination of head and pad.

3. The back applicator of claim 2 wherein said pressure-sensitive hook-type head strip and said pressure-sensitive loop-type contra strip are both made of Scotch Mate materials.

4. The back applicator of claim 2 wherein said cover is made of molded clear polypropylene.

5. The back applicator of claim 2 in a practical realization wherein:

said handle is 0.75 inch diameter and one foot in length, fabricated to a one-inch curve;

said head major surface measures 3×4 inch, further comprising a logo area for indicia, and said recess in said opposite major surface measures 2×3 inch;

said head strip with pressure-sensitive hooks measures 2×3 inch;

said pad measures 3.25×4.25×1.5 inch;

said pad contra strip with pressure-sensitive loops measures 2×3 inch; and said cover measures 3.1×4.2×1.5 inch.

* * * * *